US008280299B2

(12) United States Patent
Achiwa

(10) Patent No.: US 8,280,299 B2
(45) Date of Patent: Oct. 2, 2012

(54) IMAGE FORMING APPARATUS AND POST-PROCESSING APPARATUS

(75) Inventor: Ken Achiwa, Kawasaki (JP)

(73) Assignee: Canon Kabushiki Kaisha (JP)

( * ) Notice: Subject to any disclaimer, the term of this patent is extended or adjusted under 35 U.S.C. 154(b) by 484 days.

(21) Appl. No.: 12/496,161

(22) Filed: Jul. 1, 2009

(65) Prior Publication Data

US 2010/0003047 A1 Jan. 7, 2010

(30) Foreign Application Priority Data

Jul. 1, 2008 (JP) ..... 2008-172247

(51) Int. Cl.
*G03G 15/00* (2006.01)
*G03G 21/00* (2006.01)

(52) U.S. Cl. ..... 399/407; 399/9; 399/80; 399/91

(58) Field of Classification Search ..... 399/9, 80, 399/91, 407
See application file for complete search history.

(56) References Cited

U.S. PATENT DOCUMENTS 5,995,773 A * 11/1999 Awano ..... 399/21
6,145,826 A 11/2000 Kawata

* cited by examiner

*Primary Examiner* — Judy Nguyen
*Assistant Examiner* — Justin Olamit
(74) *Attorney, Agent, or Firm* — Rossi, Kimms & McDowell LLP

(57) ABSTRACT

An image forming apparatus capable of ensuring security of discharged printouts and preventing noise made by the operation of the image forming apparatus from becoming obtrusive to a user. The post-processing apparatus switches the operation mode of post processing to one of a normal operation mode and a quiet operation mode, and opens and closes a sealing door. Current limiting circuits switch the operation mode to the quiet operation mode before sealing of the door is released by a sealing drive circuit in response to an instruction from the user.

6 Claims, 12 Drawing Sheets

IMAGE FORMING APPARATUS AND POST-PROCESSING APPARATUS

BACKGROUND OF THE INVENTION

1. Field of the Invention

The present invention relates to an image forming apparatus for discharging sheets on which images have been formed, and a post-processing apparatus therefor.

2. Description of the Related Art

Conventionally, there has been proposed an image forming apparatus, such as a printer or a copying machine, which is provided with a post-processing apparatus for aligning ends of a plurality of sheets on which images have been formed (printed), performing post processing, such as stapling and punching, on the sheets, and discharging bundles of sheets for stacking (see U.S. Pat. No. 6,145,826).

However, the image forming apparatus proposed in U.S. Pat. No. 6,145,826 does not propose an image forming apparatus configured to meet the two requirements of ensuring the security of discharged printouts and preventing noise (machine noise) made by the operation of the image forming apparatus from becoming obtrusive to a user.

SUMMARY OF THE INVENTION

The present invention provides an image forming apparatus configured to be capable of meeting the two requirements of ensuring security of discharged printouts and preventing noise (machine noise) made by the operation of the image forming apparatus from becoming obtrusive to a user. Particularly, the present invention provides an image forming apparatus configured to be capable of preventing noise made by discharge of a printout and a post-processing operation on the printout, even when another user is performing a print job after the user releases the sealing of the post-processing apparatus and before the user acquires the printout in a discharge tray.

In a first aspect of the present invention, there is provided an image forming apparatus which includes a post-processing apparatus that seals a plurality of discharge trays by a single door, performs printing on sheets based on print data in response to a print request from a user, and then discharges the sheets onto a selected one of the discharge trays, the post-processing apparatus comprising a switching unit configured to switch an operation mode of post processing to one of a normal operation mode and a quiet operation mode, and a sealing unit configured to perform or release sealing of the door, wherein the switching unit switches the operation mode to the quiet operation mode before the sealing of the door is released by the sealing unit in response to an instruction given by the user to release the sealing of the door In a second aspect of the present invention, there is provided a post-processing apparatus that is disposed at a location downstream of an image forming apparatus in a sheet conveying direction thereof, and includes a plurality of discharge trays and a single door for sealing the discharge trays, the post-processing apparatus receiving, from the image forming apparatus, sheets on which printing has been performed based on print data in response to a print request from a user, and discharging the sheets onto a selected one of the discharge trays, comprising a switching unit configured to switch an operation mode of post processing to one of a normal operation mode and a quiet operation mode, and a sealing unit configured to perform or release sealing of the door, wherein the switching unit switches the operation mode to the quiet operation mode before the sealing of the door is released by the sealing unit in response to an instruction given by the user to release sealing of the door.

According to the present invention, it is possible to provide an image forming apparatus configured to be capable of ensuring security of discharged printouts and suppressing noise made by the operation of the image forming apparatus. Further, it is possible to construct a printing environment which is capable of reducing noise made by discharge of a printout and a post-processing operation on a printout, even when another user is performing a print job after the user releases the sealing of the post-processing apparatus and before the user acquires a printout in a discharge tray.

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing embodiments thereof.

In the present invention, from the viewpoint of providing an image forming apparatus which is more simple and inexpensive but ensures an equivalent security level, a description will be given of an image forming apparatus configured to include a number N of discharge trays which are locked by one door, by way of example.

Figure 1:
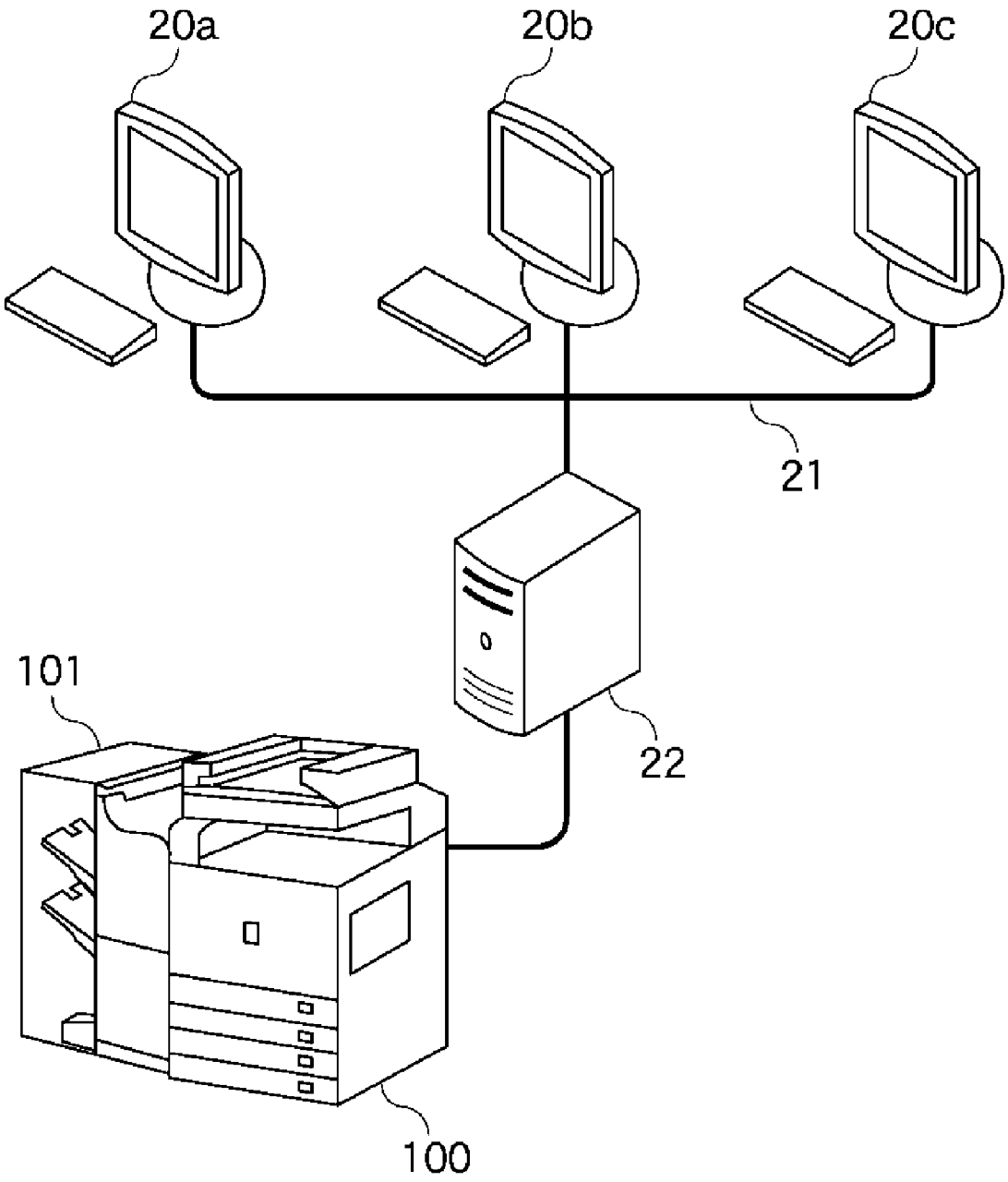
FIG. 1 is a configuration diagram of a network system to which are connected an image forming apparatus according to an embodiment of the present invention and a plurality of network terminals.

FIG. 1 is a configuration diagram of a network system to which are connected the image forming apparatus according to a first embodiment of the present invention and a plurality of network terminals.

Referring to FIG. 1, the image forming apparatus is comprised of an apparatus main unit 100 and a post-processing apparatus 101 disposed at a location downstream of the apparatus main unit 100 in a sheet conveying direction. This image forming apparatus is connected to three network terminals 20*a* to 20*c* via a network 21 and a network server 22.

That is, in the FIG. 1 example of the configuration of the network system, a single image forming apparatus is shared between the plurality of network terminals 20*a* to 20*c*. However, the number of the apparatus and terminals illustrated in the FIG. 1 example by no means limits the number of the apparatus and terminals which can be connected to the network system but a desired number of apparatuses and terminals may be connected.

The apparatus main unit 100 forms an image in response to a print request received from each of the network terminals 20*a* to 20*c* via the network 21, and prints the image on a sheet. The post-processing apparatus 101 performs a stapling process and a punching process on sheets in response to a post-processing request received via the network 21, and then discharges the sheets.

Figure 2:
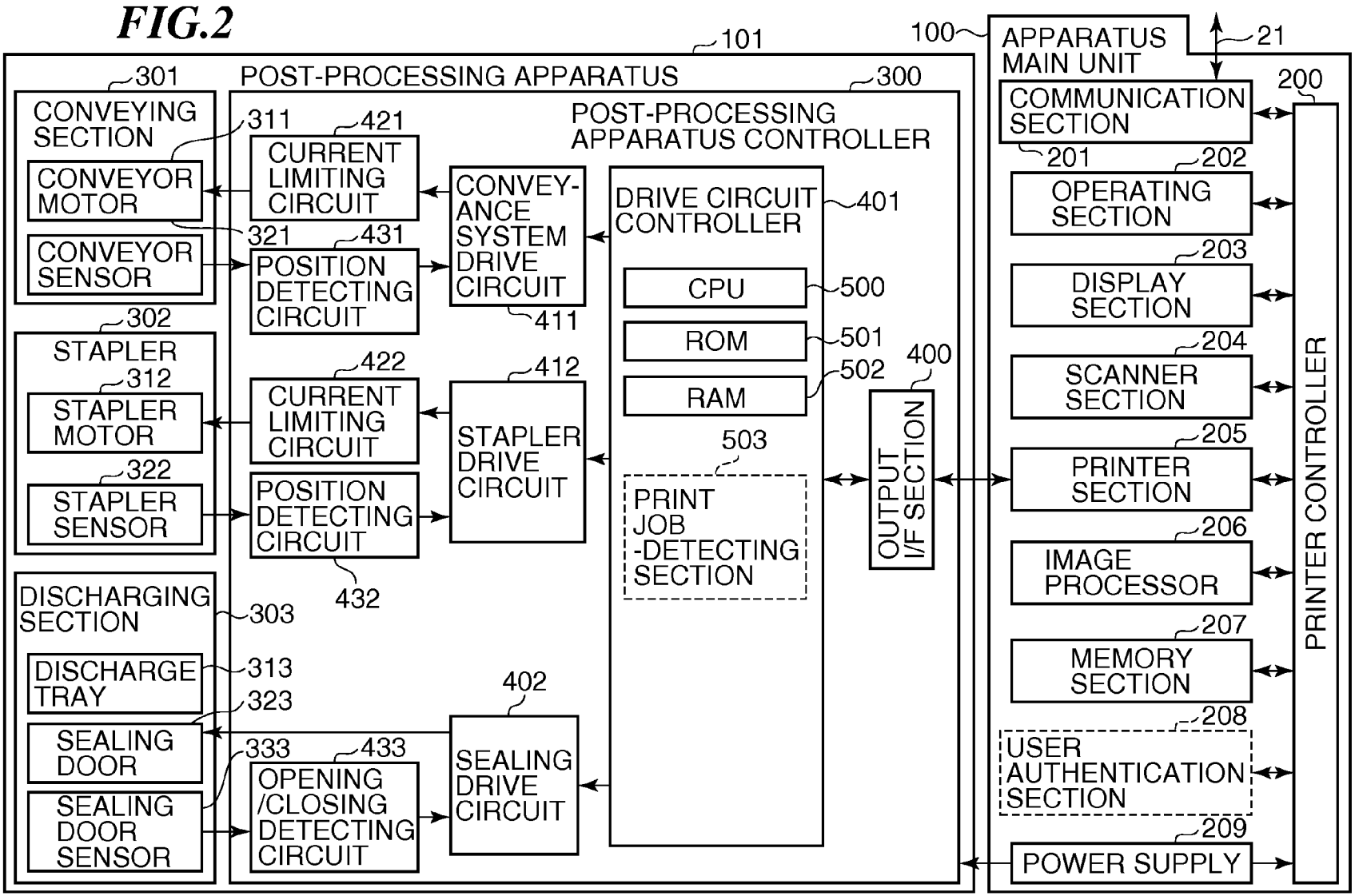
FIG. 2 is a block diagram of the image forming apparatus appearing in FIG. 1.

FIG. 2 is a block diagram of the image forming apparatus appearing in FIG. 1.

Referring to FIG. 2, the apparatus main unit 100 is connected to the external network 21 via a communication section 201 and is connected to the post-processing apparatus 101 via a printer section 205 thereof. On the other hand, the post-processing apparatus 101 is connected to the apparatus main unit 100 via an output interface section 400 thereof. The post-processing apparatus 101 performs data communication with the apparatus main unit 100 via the output interface section 400 to thereby transmit and receive print data and information concerning post-processing operations to and from the apparatus main unit 100.

The apparatus main unit 100 is assumed to be a multifunction peripheral (MFP) which is capable of realizing a plurality of different functions, such as a copy function, a printing function, a scanning function, and a facsimile function.

Further, the apparatus main unit 100 is comprised of a printer controller 200, the communication section 201, an operating section 202, a display section 203, a scanner section 204, the printer section 205, an image processor 206, a memory section 207, and a power supply 209.

The printer controller 200 controls the overall operation of the apparatus main unit 100. The printer controller 200 is electrically connected to the respective processing sections, such as the printer section 205 and the scanner section 204, for causing the processing sections to operate in a cooperative manner between them, whereby the apparatus main unit 100 in its entirety provide the above-mentioned functions to the user.

For example, the printer controller 200 controls the scanner section 204 to read image data from an original and controls the printer section 205 to print out the image data on sheets, thereby providing the copy function to the user.

Further, the printer controller 200 transmits the image data read from the scanner section 204 to the network 21 via the communication section 201, thereby providing the scanning function (network transmission).

Further, the printer controller 200 converts code data received from the network 21 via the communication section 201 to image data using the image processor 206, and then outputs the resulting image data to the printer section 205, thereby providing the printing function (PDL output).

The communication section 201 performs transmission and reception of data to and from external apparatuses (the network terminals). The communication section 201 is connected to the network 21, such as the Internet and a LAN, for transmission and reception of data to and from the external apparatuses. Further, the communication section 201 is connected to a public telephone line to thereby perform facsimile communication or is directly connected to a PC via a USB interface, thereby performing data communication therebetween.

Figure 3:
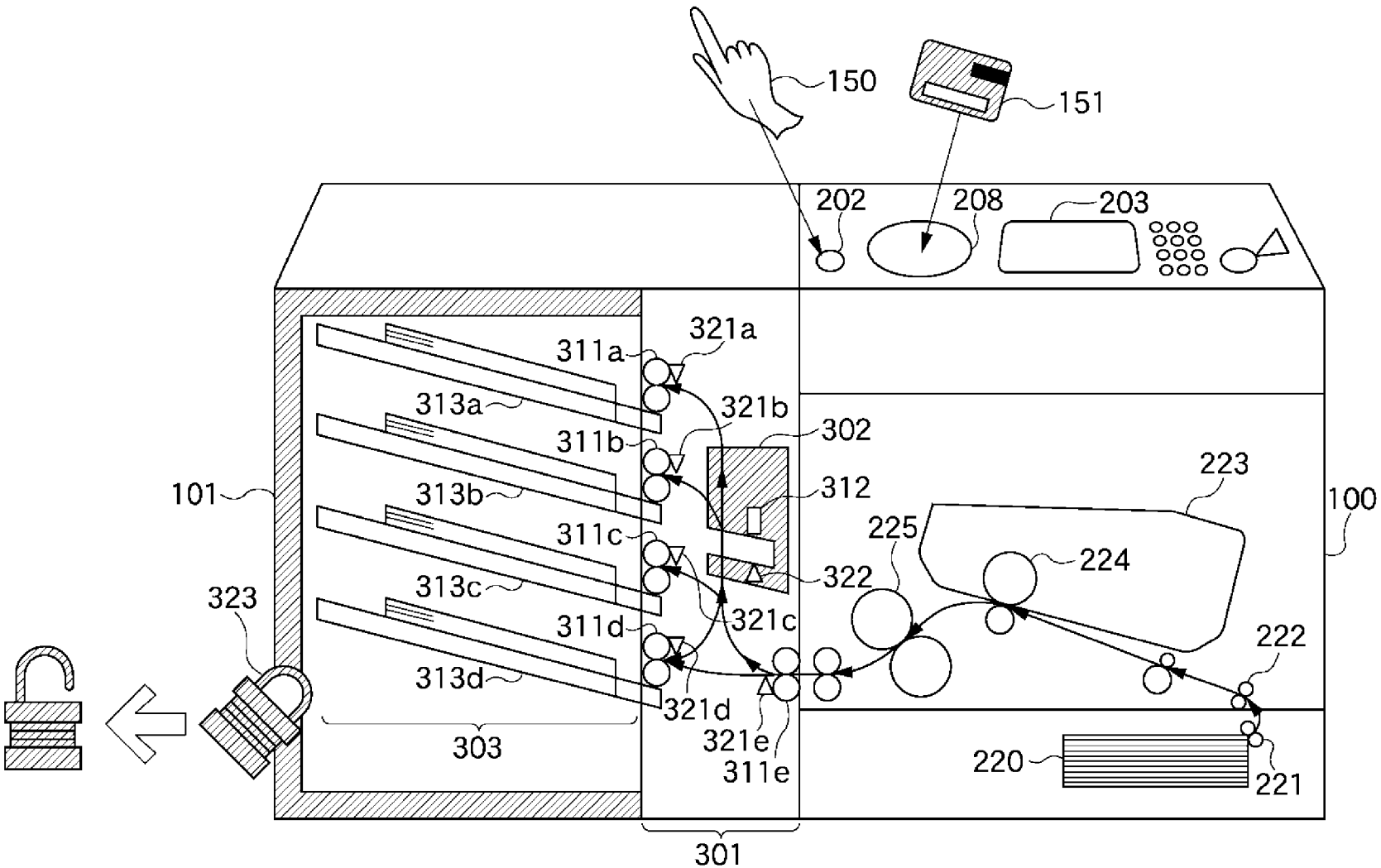
FIG. 3 is a schematic diagram showing the configuration of the FIG. 2 image forming apparatus.

The operating section 202 causes the user to select an operation that the user desires to perform, through a key operation 150 (see FIG. 3). The operating section 202 is comprised e.g. of operation buttons and a liquid crystal touch panel, thereby providing user interface for operating the apparatus main unit 100.

The display section 203 displays operation instructions or print previews of images to be printed, for the user, and is formed e.g. by a liquid crystal panel.

In recent years, with an increase in the size of the liquid crystal panel, the display section 203 and the operating section 202 more often come to be implemented by a liquid crystal panel in which they are integrated The display section 203 shown in FIG. 3 as well provides a similar user interface which the user can operate.

Therefore, the apparatus main unit 100 receives the key operation 150 from an operated one of hard keys of the operating section 202 and soft keys displayed on the display section 203.

The scanner section 204 optically reads the image of an original and converts the same to an electrical image signal. The scanner section 204 is comprised of a contact image sensor, a reading driver, a read lighting controller, and so forth.

When the whole original is scanned by the contact image sensor conveyed by the reading driver, LEDs inside the contact image sensor are caused to be lighted i.e. turned on by the read lighting controller. At the same time, a photosensor inside the contact image sensor optically reads the original image, and converts the original image to an electrical image signal.

The printer section 205 prints the electrical image signal on sheets as visible images. The printer section 205 is implemented by a laser beam printer or an inkjet printer.

The image processor 206 performs read image processing, communication image processing and recording image processing.

The read image processing performs shading correction and the like on image data received from the scanner section 204, gamma correction, binarization processing, halftone processing, and color conversion, such as RGB-to-CMYK conversions, for converting the image data to high precision image data.

The recording image processing performs resolution conversion on the image data according to a recording resolution. More specifically, the recording image processing performs various kinds of image processing, such as zooming, smoothing, and density correction, on the image data, to thereby convert the same to high precision image data for output to the laser beam printer or the like.

The communication image processing performs resolution conversion and color conversion on read image data according to the communication performance, or performing resolution conversion and the like on image data received by communication according to the recording performance.

The memory section 207 is a memory device, such as a DDR-SDRAM and an HDD, and not only temporarily stores image data but also stores control programs, data and the like, used by the printer controller 200 so as to realize the functions of the image forming apparatus.

The power supply 209 supplies electric power to the apparatus main unit 100 and the post-processing apparatus 101, and is connected to the printer controller 200 and a post-processing apparatus controller 300, referred to hereinafter. The power supply 209 supplies electric power required for operation (driving) of the processing sections (devices) connected to the respective controllers 200 and 300.

The post-processing apparatus 101 includes the post-processing apparatus controller 300, a conveying section 301, a stapler 302 as a post-processing device, and a discharging section 303.

The post-processing apparatus controller 300 controls the overall operation of the post-processing apparatus 101, and is comprised of an output interface section 400, a drive circuit controller 401, and drive circuits 411 and 412 associated with processing sections including the conveying section 301 and the stapler 302.

The post-processing apparatus controller 300 also includes current limiting circuits 421 and 422, position detecting circuits 431 and 432, a sealing drive circuit 402, and an opening/closing detecting circuit 433.

The output interface section 400 is a data communication section connected to the apparatus main unit 100. The post-processing apparatus 101 performs data communication with the apparatus main unit 100 via the output interface section 400 to thereby transmit and receive print data and information concerning post-processing operations to and from the apparatus main unit 100.

The drive circuit controller 401 is comprised of a central processing unit (CPU) 500, a nonvolatile memory (ROM) 501 for storing a control program, and a volatile memory (RAM) 502 for temporarily storing data during execution of the control program.

However, the configuration for storing and executing the program and temporarily storing the data is not limited to the configuration of the above-described example but other recording media or memories may be employed.

The sealing drive circuit 402 controls the opening and closing operations of a sealing door 323 provided in the discharging section 303. The opening/closing detecting circuit 433 detects opened and closed states of the sealing door 323 provided in the discharging section 303.

The opening/closing detecting circuit 433 receives a detection signal from a sealing door sensor 333 that detects the position of the sealing door 323 of the discharging section 303, electrically converts the detection signal to an opened/closed state signal, and outputs the opened/closed state signal thus generated by conversion, to the sealing drive circuit 402.

The sealing drive circuit 402 performs or releases the sealing of the sealing door 323 in a state closed by the user, in response to the opened/closed state signal from the opening/closing detecting circuit 433.

The drive circuits (the conveyance system drive circuit 411 and the stapler drive circuit 412) are processing sections which generate control signals for drivingly controlling processing sections, such as the conveying section 301 and the stapler 302.

The current limiting circuits 421 and 422 control the upper limit values of driving currents when the above control signals drivingly control the processing sections, such as the conveying section 301 and the stapler 302.

The current limiting circuits 421 and 422 control the upper limit values of the driving currents to thereby cause a conveyor motor 301 of the conveying section 301 to perform a low-speed operation (including a temporary stoppage) and a stapler motor 312 of the stapler 302 to perform a low-speed operation (including a temporary stoppage), respectively.

The position detecting circuits 431 and 432 are processing sections which generate position information for drivingly controlling the processing sections, such as the conveying section 301 and the stapler 302.

The position detecting circuits 431 and 432 receive respective detection signals from detection sensors 321 and 322 of the above processing sections 301 and 302, electrically convert the detection signals to position information signals, and output the position information signals thus generated by conversion to the drive circuits 411 and 412 for the processing sections.

The conveying section 301 includes the conveyor motor 301 and the conveyor sensor 321.

The conveyor motor 301 is provided for conveying and discharging printed sheets, and is driven at a speed (including a temporary stoppage) dependent on a control signal which is input from the conveyance system drive circuit 411 via the current limiting circuit 421.

The conveyor sensor 321 detects whether or not a sheet being conveyed exists at a location where the conveyor sensor 321 is disposed, and delivers a signal indicative of whether or not a sheet exists at the location where the conveyor sensor 321 is disposed, to the position detecting circuit 431 associated therewith.

The stapler 302 includes the stapler motor 312 and the stapler sensor 322.

The stapler motor 312 is provided for executing a stapling operation on printed sheets as post processing, and is driven at a speed (including a temporary stoppage) dependent on a control signal which is input from the stapler drive circuit 412 via the current limiting circuit 422.

The stapler sensor 322 detects whether or not there are any sheets being prepared for stapling at a location where the stapler sensor 322 is disposed, and delivers a detection signal indicative of whether or not there are any sheets at the location where the stapler sensor 322 is disposed, to the position detecting circuit 432 associated therewith.

The discharging section 303 includes discharge trays 313 (313*a* to 313*d* (see FIG. 3)), the sealing door 323 and the sealing door sensor 333.

The discharge trays 313 are provided for stacking sheets on which image data is printed out by the apparatus main unit 100, and then the post processing has been performed by the post-processing apparatus 101.

The sealing door 323 covers all the discharge trays 313*a* to 313*d*. The sealing door 323 ensures the security of printouts (printed sheets) stacked on the discharge trays 313*a* to 313*d* inside the discharging section 303, and blocks noise made by the operation of the post-processing apparatus 101, which can leak out from the apparatus.

The sealing door sensor 333 detects the position of the sealing door 323, and delivers a signal indicative of the detected position of the sealing door 323 to the opening/closing detecting circuit 433.

The current limiting circuits 421 and 422 function as switching units for switching the operation mode of the post-processing apparatus 101 in the post-processing to one of a normal operation mode and a quiet operation mode. Further, the sealing drive circuit 402 functions as a sealing unit for performing or releasing the sealing of the sealing door 323.

FIG. 3 is a schematic diagram showing the configuration of the image forming apparatus appearing in FIG. 2.

In the following, the mechanical configuration of the image forming apparatus will be described along with operations of the printing function (PDL output) of the same.

As shown in FIG. 3, when the apparatus main unit 100 receives a print request via the external network 21, referred to hereinabove with reference to FIG. 1, the apparatus main unit 100 drives rollers, such as a pickup roller 221 and a feed retard roller 222, provided in a sheet feeder section, for conveying a sheet from a feed tray 220.

Then, the apparatus main unit 100 generates image data according to the print request using the image processor 206, described above with reference to FIG. 2, and forms an image on the upper surface of the sheet based on the image data using an electrophotographic processing section 224 including a toner cartridge 223. Subsequently, the apparatus main unit 100 fixes the image on the upper surface of the sheet by a fixing section 225, and discharges the sheet into the post-processing apparatus 101.

As shown in FIG. 3, the post-processing apparatus 101 receives the sheet discharged from the apparatus main unit 100, and conveys the sheet using the conveying section 301, described above with reference to FIG. 2.

Now, when the apparatus main unit 100 receives a print request in which a post-processing request e.g. for stapling is included, the apparatus main unit 100 sends a signal notifying the post-processing request to the post-processing apparatus 101. The post-processing apparatus 101 receives the signal by data communication via the output interface section 400. Then, the post-processing apparatus 101 performs desired post processing designated by the notification signal using post-processing devices, such as the stapler 302, described above with reference to FIG. 2.

After that, the post-processing apparatus 101 discharges and stacks a printout (printed sheets) subjected to the desired post processing, on a selected one of the discharge trays 313*a* to 313*d* of the discharging section 303.

Next, a description will be given of the outline of the operation of the post-processing apparatus 101, which characterizes the present invention.

The post-processing apparatus 101 accepts, for example, an instruction given by a user A, who has caused a printout to be discharged on the discharge tray 313*a*, via the operating section 202, while a printout is being discharged onto the discharge tray 313*b* according to a print request by a user B.

Then, the post-processing apparatus 101 controls the motors 311 and 312 of the conveying section 301 and the stapler 302 to switch the operation mode to the quiet operation mode, and then releases the sealing of the sealing door 323.

After that, the post-processing apparatus 101 uses the sealing door sensor 333 to thereby detect that the sealing door 323 has been opened by the user A, and further detect that the sealing door 323 is closed after the printout of the user A is taken out from the discharge tray 313*a*.

Then, after sealing the sealing door 323, the post-processing apparatus 101 controls the motors 311 and 312 of the conveying section 301 and the stapler 302 and the like to return to the normal operation mode.

By carrying out the above operations, the post-processing apparatus 101 reduces the noises generated by the operations, which can leak out from the apparatus in a state in which the sealing door 323 has been opened by the user A in the case of the above-described example.

Although in FIGS. 2 and 3, the stapler 302 has been described as an example of a post-processing device configured according to the present embodiment, this is not limitative, but for example, the a configuration using a post-processing device, such as an alignment device for aligning ends of sheets in the direction of the width thereof, a puncher for forming punched holes in the sheets, other than the stapler, may also be employed.

Further, although in FIGS. 2 and 3, the configuration in which the operating section 202 (and the display section 203 that can be operated) is included in the apparatus main unit 100 is illustrated, a configuration may be employed in which the operating section 202 (and the operation of the display section 203) is included in the post-processing apparatus 101.

Figure 4:
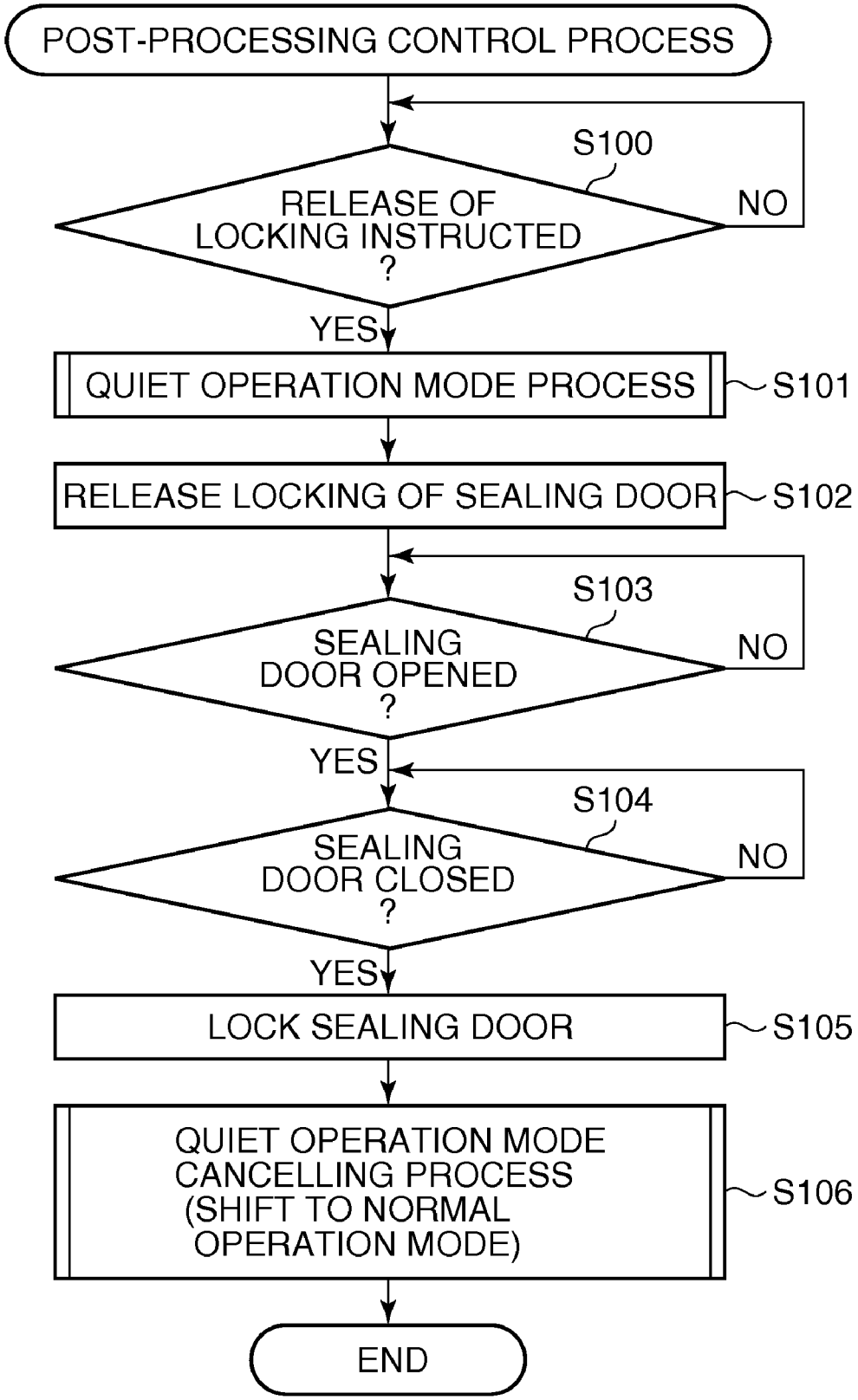
FIG. 4 is a flowchart of a post-processing control process executed by the FIG. 2 image forming apparatus.

FIG. 4 is a flowchart of a post-processing control process executed by the FIG. 2 image forming apparatus.

More specifically, the post-processing control process shown in FIG. 4 is performed under the control of the post-processing apparatus controller 300 of the post-processing apparatus 101 shown in FIG. 2.

The post-processing apparatus controller 300 awaits a user input for instructing release of the sealing (locking) of the sealing door 323, from the operating section 202 (or the display section 203 that can be operated) (step S100), and if the release of the sealing of the sealing door 323 is instructed (YES to the step S100), the process proceeds to a step S101.

In the step S101, by using the current limiting circuits 421 and 422, the post-processing apparatus controller 300 switches the operation mode from an operation mode (normal operation mode) in which the upper limit values of driving currents supplied to the devices are not restricted, to an operation mode (quiet operation mode) in which the upper limit values of the driving currents supplied to the devices are restricted. A process in the quiet operation mode (quiet operation mode process) will be described in more detail hereinafter with reference to FIG. 5.

Further, the post-processing apparatus controller 300 releases the sealing (locking) of the sealing door 323, using the sealing drive circuit 402 (step S102).

Then, the post-processing apparatus controller 300 determines, using the opening/closing detecting circuit 433, whether or not the sealing door 323 in the closed state has been opened by a user (step S103).

More specifically, the opening/closing detecting circuit 433 generates an internal signal indicative of one of a opened state or a closed state of the sealing door 323, as an opened/closed state signal based on a detection signal from the sealing door sensor 333, and stores the signal as status information associated with the sealing door 323. Here, if the status information is changed from information indicative of the closed state, which is the initial state of the sealing door, to information indicative of the open state (YES to the step S103), the process proceeds to a step S104, whereas if the status information remains indicative of the closed state (NO to the step S103), the post-processing apparatus controller 300 waits until the status information becomes indicative of the open state.

In the step S104, the post-processing apparatus controller 300 determines, using the opening/closing detecting circuit 433, whether or not the sealing door 323 in the opened state has been closed by the user.

More specifically, if the status information becomes indicative of the closed state (YES to the step S104), the process proceeds to a step S105, whereas if the status information remains indicative of the open state (NO to the step S104), the post-processing apparatus controller 300 waits until the status information becomes indicative of the closed state.

In the step S105, the post-processing apparatus controller 300 performs the sealing (locking) of the sealing door 323, using the sealing drive circuit 402.

Further, in a step S106, by using the current limiting circuits 421 and 422, the post-processing apparatus controller 300 switches the operation mode from the operation mode (quiet operation mode) in which the upper limit values of the driving currents supplied to the devices are restricted, to the operation mode (normal operation mode) in which the upper limit values of the driving currents supplied to the devices are not restricted. The cancellation of the quiet operation mode (shift to the normal operation mode) will be described in more detail hereinafter with reference to FIG. 6.

Although the post-processing control process is configured such that in the step S103 in FIG. 4, the post-processing apparatus controller 300 is caused to wait until the sealing door 323 is opened by the user, the present invention is not particularly limited to this configuration.

To cope with the case in which the sealing door 323 is not opened by the user, the post-processing apparatus controller 300 may be provided with a timer which measures the lapse of time after the release of the sealing of the sealing door 323. When the timer detects the lapse of a predetermined time period, the process may proceed to the step S105 so as to perform the sealing (locking) of the sealing door 323 again. This also completely applies to processes described hereinafter with reference to FIGS. 7, 8, 9 and 12.

Further, although the post-processing control process is configured such that in the step S104 in FIG. 4, the post-processing apparatus controller 300 is caused to wait until the sealing door 323 is closed by the user, the present invention is not particularly limited to this configuration.

To cope with the case in which the sealing door 323 is not closed by the user, the post-processing apparatus controller 300 may be provided with a timer which measures the lapse of time after the status information stored in the opening/closing detecting circuit 433 becomes indicative of the open state. When the timer detects the lapse of a predetermined time period, an error message, such as "Please close the sealing door." may be displayed on the display section 203 so as to instruct or urge the user to close the sealing door. This also completely applies to the processes described hereinafter with reference to FIGS. 7, 8, 9 and 12.

Figure 5:
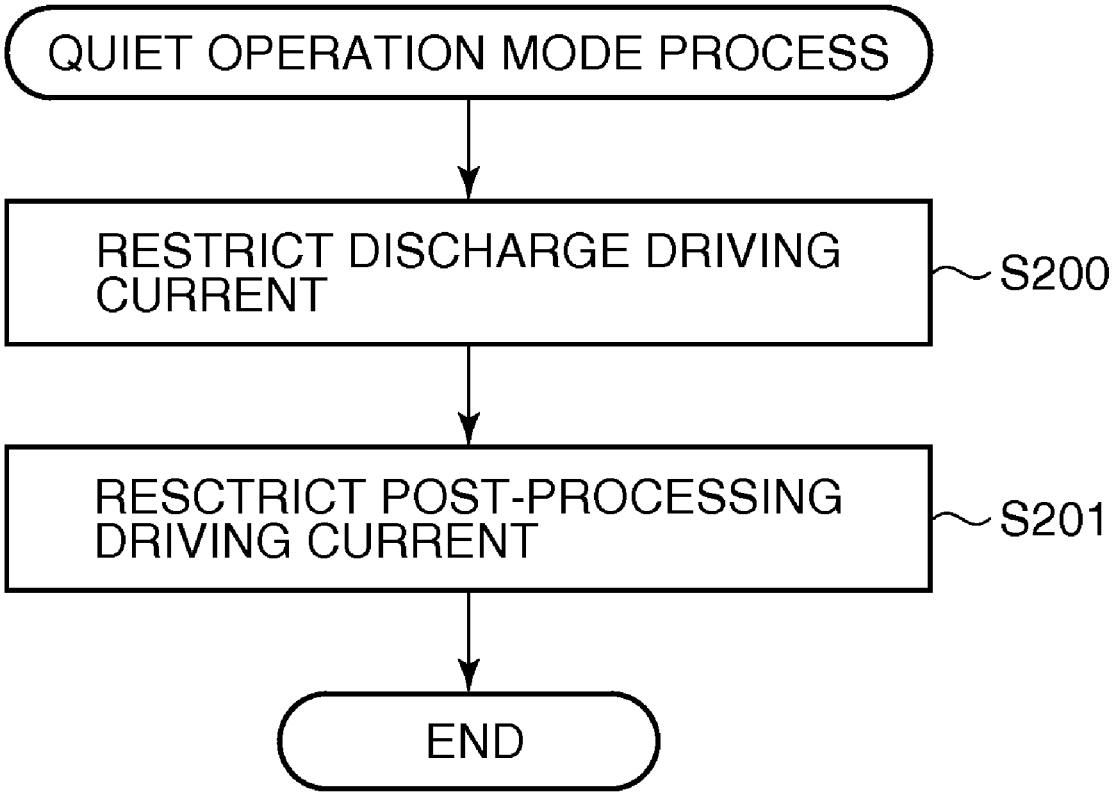
FIG. 5 is a flowchart of a quiet operation mode process executed in a step in FIG. 4.

FIG. 5 is a flowchart of the quiet operation mode process executed in the step S101 in FIG. 4.

The post-processing apparatus controller 300 restricts the upper limit value of the driving current supplied to the conveyor motor 301 of the conveying section 301, using the current limiting circuit 421 (S200). Here, the term "to restrict the upper limit value of the driving current" is intended to mean that the upper limit value is set e.g. to half the driving current supplied to the conveyor motor 301 of the conveying section 301 in the normal operation mode to thereby cause the conveyor motor 301 to perform a low-speed operation or that the upper limit value is set to zero to thereby cause the conveyor motor 301 to temporarily stop (step S201).

Further, the post-processing apparatus controller 300 restricts the upper limit value of the driving current supplied to the stapler motor 312 of the stapler 302, using the current limiting circuit 422 (S201. Here, the term "to restrict the upper limit value of the driving current" is intended to mean, for example, that the upper limit value is set to half the driving current supplied to the stapler motor 312 of the stapler 302 in the normal operation mode to thereby cause the stapler motor 312 to perform a low-speed operation or that the upper limit value is set to zero to thereby cause the stapler motor 312 to stop temporarily.

Figure 6:
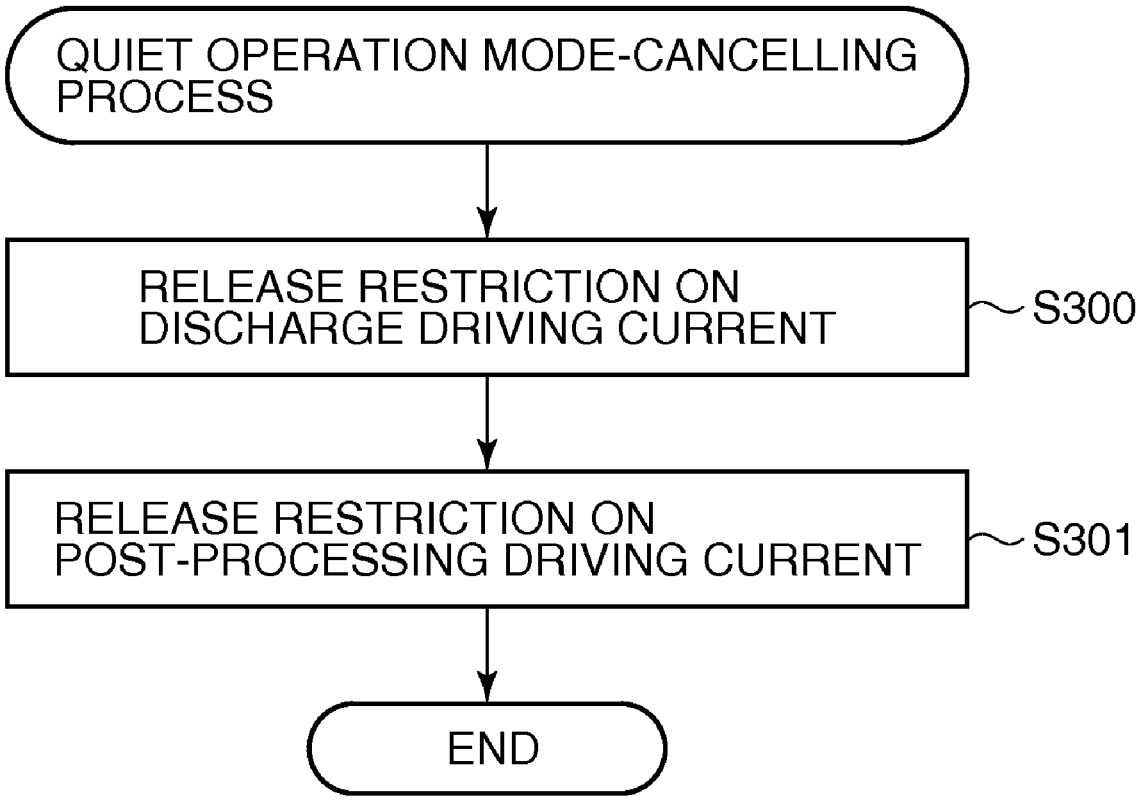
FIG. 6 is a flowchart of a quiet operation mode-cancelling process performed in a step in FIG. 4.

FIG. 6 is a flowchart of a quiet operation mode-cancelling process performed in the step S106 in FIG. 4.

The post-processing apparatus controller 300 releases the restriction on the driving current supplied to the conveyor motor 301 of the conveying section 301, by using the current limiting circuit 421 (step S300). This restriction has been applied in the step S200 in FIG. 5.

The post-processing apparatus controller 300 releases the restriction on the driving current supplied to the stapler motor 312 of the stapler 302, using the current limiting circuit 422 (step S301). This restriction has been applied in the step S201 in FIG. 5.

Next, a second embodiment of the present invention will be described with reference to FIGS. 2, 7 and 8.

In the second embodiment, as shown in FIG. 2, the drive circuit controller 401 of the post-processing apparatus controller 300 in the post-processing apparatus 101 is provided with a print job-detecting section 503, shown in a box indicated by broken lines.

The print job-detecting section 503 detects whether or not a discharge operation and a post-processing operation are being performed on printed sheets in response to a print request other than the print request according to which the discharge of the printed sheets onto one of the discharge trays 313*a* to 313*d* has been completed.

The print job-detecting section 503 functions as a detection unit for detecting whether or not at least one print data item is being processed in response to a print request from the user.

Although in FIG. 2, the print job-detecting section 503 is shown as an independent or separate section, the function of the print job-detecting section 503 may be realized using the aforementioned CPU 500, ROM 501 or RAM 502. An image forming apparatus according to the second embodiment is configured similarly to the image forming apparatus according to the first embodiment in the other hardware components. Therefore, the corresponding elements are denoted by identical reference numerals, and description thereof is omitted.

Figure 7:
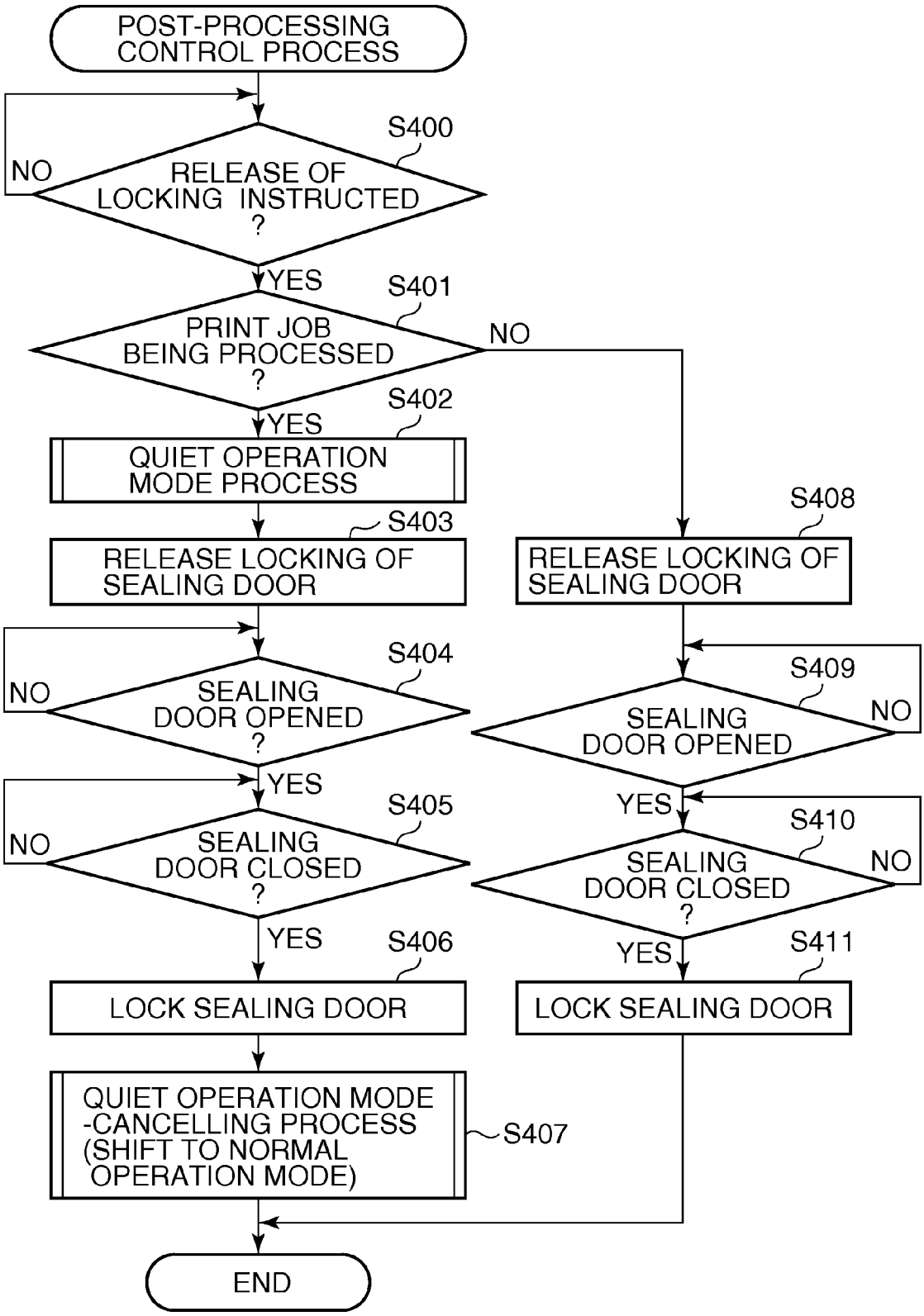
FIG. 7 is a flowchart of a post-processing control process executed by an image forming apparatus according to a second embodiment of the present invention.

FIG. 7 is a flowchart of a post-processing control process executed by the image forming apparatus (including the print job-detecting section 503) according to the second embodiment. The post-processing apparatus controller 300 awaits a user input for instructing release of the sealing (locking) of the sealing door 323, from the operating section 202 (or the display section 203 that can be operated) (step S400), and if the release of the sealing of the sealing door 323 is instructed (YES to the step S400), the process proceeds to a step S401.

In the step S401, the post-processing apparatus controller 300 determines, using the print job-detecting section 503, whether or not a print job, i.e. a discharge operation and a post-processing operation are being performed on printed sheets, in response to another print request. If a print job is being processed (YES to the step S401), the process proceeds to a step S402, whereas if no print job is being processed (NO to the step S401), the process proceeds to a step S408.

In the step S402 to a step S407, the same processing is carried out as carried out in the steps S101 to S106 of the post-processing control process in FIG. 4 executed by the image forming apparatus according to the first embodiment.

On the other hand, if no print job is being processed, the process proceeds to the step S408, wherein the post-processing apparatus controller 300 releases the sealing (locking) of the sealing door 323 using the sealing drive circuit 402.

Then, the post-processing apparatus controller 300 determines, using the opening/closing detecting circuit 433, whether or not the sealing door 323 in the closed state has been opened by the user (step S409).

More specifically, if the status information becomes indicative of the open state (YES to the step S409), the process proceeds to a step S410, whereas if the status information remains indicative of the closed state (NO to the step S409), the post-processing apparatus controller 300 waits until the status information becomes indicative of the open state.

In the step S410, the post-processing apparatus controller 300 determines, using the opening/closing detecting circuit 433, whether or not the sealing door 323 in the opened state has been closed by the user.

More specifically, if the status information is becomes indicative of the closed state (YES to the step S410), the process proceeds to a step S411, whereas if the status information remains indicative of the open state (NO to the step S410), the post-processing apparatus controller 300 waits the process until the status information becomes indicative of the closed state.

In the step S411, the post-processing apparatus controller 300 performs the sealing (locking) of the sealing door 323, using the sealing drive circuit 402.

Figure 8:
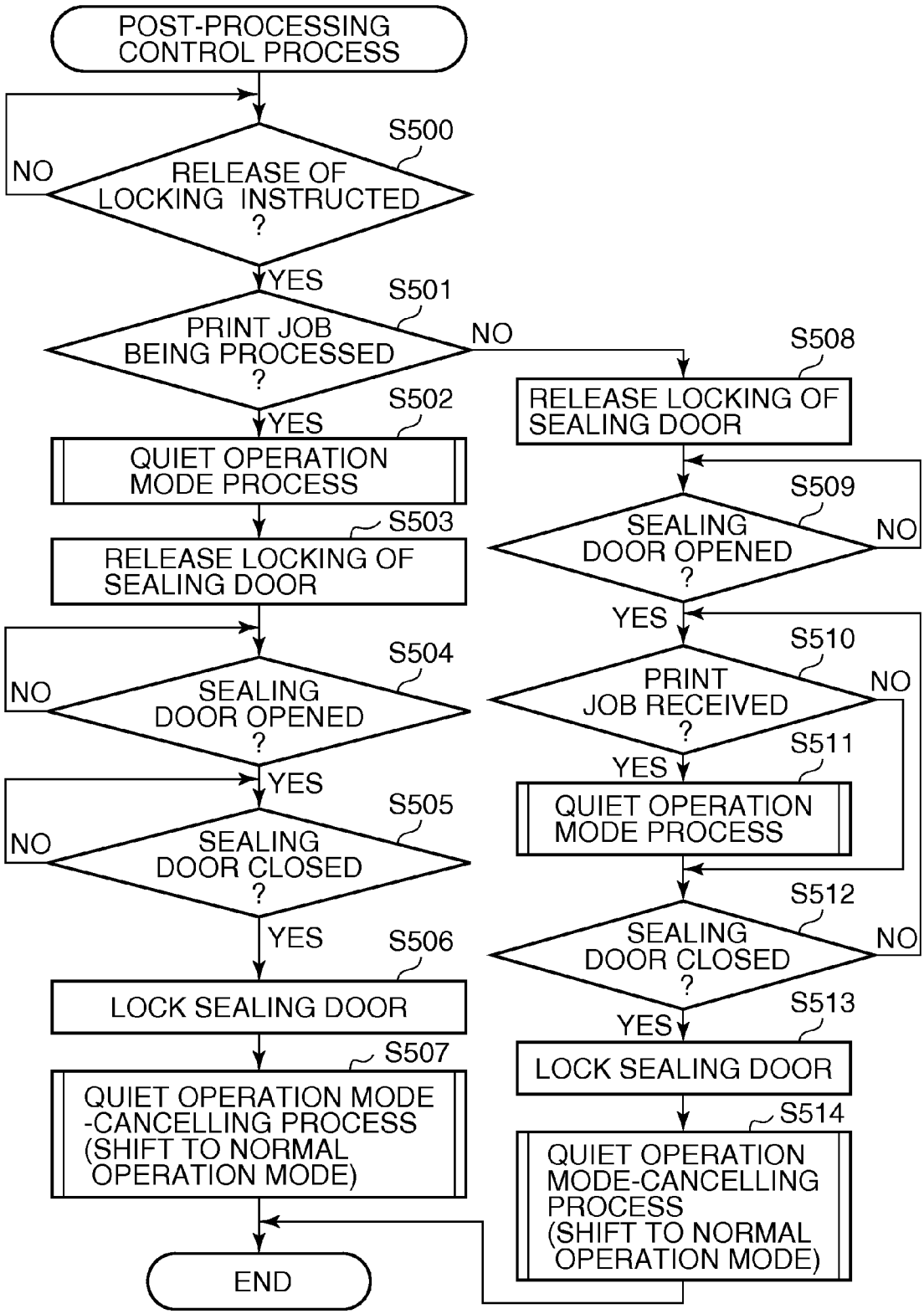
FIG. 8 is a flowchart of a variation of the post-processing control process executed by the image forming apparatus according to the second embodiment.

FIG. 8 is a flowchart of a variation of the post-processing control process executed by the image forming apparatus (including the print job-detecting section 503) according to the second embodiment.

The processing executed in the steps S500 to S507 is similar to that executed in the steps S400 to S407 of the FIG. 7 post-processing control process executed by the image forming apparatus according to the second embodiment.

On the other hand, if no print job is being processed in the step S501, the post-processing apparatus controller 300 releases the sealing (locking) of the sealing door 323 using the sealing drive circuit 402 in a step S508.

Next, the post-processing apparatus controller 300 determines, using the opening/closing detecting circuit 433, whether or not the sealing door 323 in the closed state has been opened by the user (step S509).

More specifically, if the status information becomes indicative of the open state (YES to the step S509), the process proceeds to a step S510, whereas if the status information remains indicative of the closed state (NO to the step S509), the post-processing apparatus controller 300 waits until the status information becomes indicative of the open state.

Next, in the step S510, in the state of the sealing (locking) of the sealing door 323 being released, the post-processing apparatus controller 300 determines, using the print job-detecting section 503, whether or not a new request for starting a discharge operation and a post-processing operation on printed sheets issued according to another print request has been detected. If the request has been detected (YES to the step S510), the process proceeds to a step S511, whereas if the request has not been detected (NO to the step S510), the process proceeds to a step S512.

In the step S511, by using the current limiting circuits 421 and 422, the post-processing apparatus controller 300 switches the operation mode from the operation mode (normal operation mode) in which the upper limit values of the driving currents supplied to the devices are not restricted, to the operation mode (quiet operation mode) in which the upper limit values of the driving currents supplied to the devices are restricted.

Next, the post-processing apparatus controller 300 detects, using the opening/closing detecting circuit 433, whether or not the sealing door 323 in the opened state has been closed by the user (step S512).

More specifically, if the status information becomes indicative of the closed state, the process proceeds to a step S513, whereas if the status information remains indicative of the open state (NO to the step S512), the post-processing apparatus controller 300 waits until the status information becomes indicative of the closed state.

In the step S513, the post-processing apparatus controller 300 performs the sealing (locking) of the sealing door 323, using the sealing drive circuit 402.

Further, by using the current limiting circuits 421 and 422, the post-processing apparatus controller 300 switches the operation mode from the operation mode (quiet operation mode) in which the upper limit values of the driving currents supplied to the devices are restricted, to the operation mode (normal operation mode) in which the upper limit values of the driving currents supplied to the devices are not restricted (step S514).

Although in FIG. 8, as the process for coping with detection of another new print request in the state of the sealing of the sealing door 323 being released, there is described an example in which the operation mode shifts to the quiet operation mode, the present invention is not particularly limited to the above-described example.

As another example of the coping process, the following one may be performed

The CPU 500 saves a print request newly detected by the print job-detecting section 503 in the RAM 502, and after sealing the sealing door 323, the CPU 500 reads out the print request from the RAM 502. Then, the CPU 500 starts a discharge operation and a post-processing operation on printed sheets, according to the print request.

Next, a third embodiment of the present invention will be described with reference to FIGS. 9 to 11. The third embodiment is configured similarly to the first embodiment in the hardware components. Therefore, the corresponding elements are denoted by identical reference numerals, and description thereof is omitted.

Figure 9:
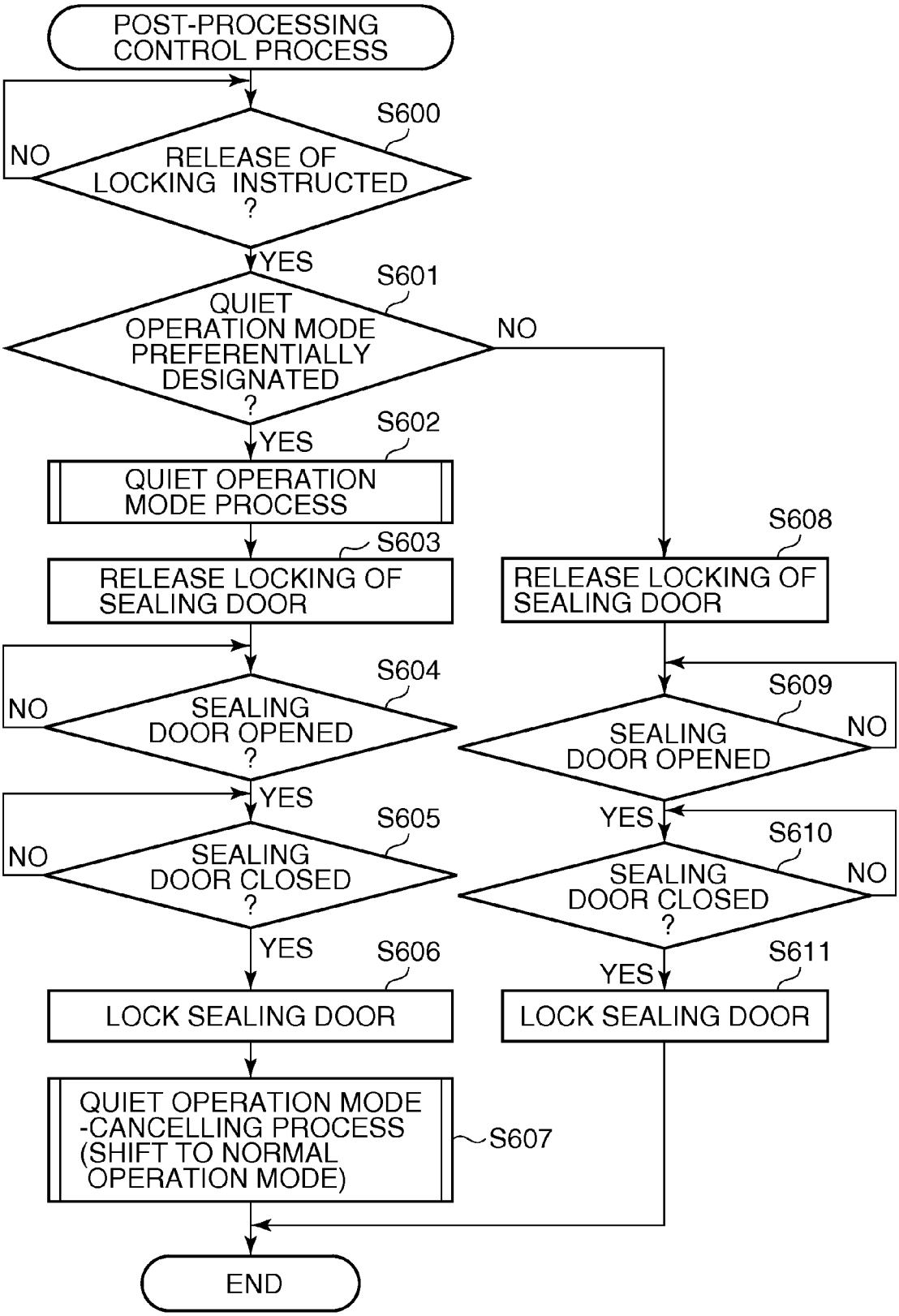
FIG. 9 is a flowchart of a post-processing control process executed by an image forming apparatus according to a third embodiment of the present invention.

FIG. 9 is a flowchart of a post-processing control process executed by the image forming apparatus according to the third embodiment.

The post-processing apparatus controller 300 awaits a user input for instructing release of the sealing (locking) of the sealing door 323, from the operating section 202 (or the display section 203 that can be operated) (step S600), and if the release of the sealing of the sealing door 323 is instructed (YES to the step S600), the process proceeds to a step S601.

In the step S601, the post-processing apparatus controller 300 refers to configuration information stored in the RAM 502 using the CPU 500, and determines whether or not the quiet operation mode is configured to be set on a priority basis as an operation mode when the sealing (locking) of the sealing door 323 is released. If the quiet operation mode is configured to be set on a priority basis (YES to the step S601), the process proceeds to a step S602, whereas if the quiet operation mode is not configured to be set on a priority basis (NO to the step S601), the process proceeds to a step S608.

In the step S602, by using the current limiting circuits 421 and 422, the post-processing apparatus controller 300 switches the operation mode from the operation mode (normal operation mode) in which the upper limit values of driving currents supplied to the devices are not restricted, to the operation mode (quiet operation mode) in which the upper limit values of the driving currents supplied to the devices are restricted. The quiet operation mode process will be described in more detail hereinafter with reference to FIG. 10.

Next, in a step S603, the post-processing apparatus controller 300 releases the sealing (locking) of the sealing door 323, using the sealing drive circuit 402.

Then, using the opening/closing detecting circuit 433, the post-processing apparatus controller 300 determines whether or not the sealing door 323 in the closed state has been opened by the user (step S604).

More specifically, if the status information becomes indicative of the open state (YES to the step S604), the process proceeds to a step S605, whereas if the status information remains indicative of the closed state (NO to the step S604), the post-processing apparatus controller 300 waits until the status information becomes indicative of the open state.

In the step S605, using the opening/closing detecting circuit 433, the post-processing apparatus controller 300 determines whether or not the sealing door 323 in the opened state has been closed by the user.

More specifically, if the status information becomes indicative of the closed state (YES to the step S605), the process proceeds to a step S606, whereas if the status information remains indicative of the open state (NO to the step S605), the post-processing apparatus controller 300 waits until the status information becomes indicative of the closed state.

In the step S606, the post-processing apparatus controller 300 performs the sealing (locking) of the sealing door 323, using the sealing drive circuit 402.

Further, in a step S607, by using the current limiting circuits 421 and 422, the post-processing apparatus controller 300 switches the operation mode from the operation mode (quiet operation mode) in which the upper limit values of the driving currents supplied to the devices are restricted, to the operation mode (normal operation mode) in which the upper limit values of the driving currents supplied to the devices are not restricted. The release of the quiet operation mode (shift to the normal operation mode) will be described in more detail hereinafter with reference to FIG. 11.

On the other hand, if the quiet operation mode is configured to be set on a priority basis (NO to the step S608), the post-processing apparatus controller 300 releases the sealing (locking) of the sealing door 323, using the sealing drive circuit 402.

Then, using the opening/closing detecting circuit 433, the post-processing apparatus controller 300 detects whether or not the sealing door 323 in the closed state has been opened by the user (step S609).

More specifically, if the status information becomes indicative of the open state (YES to the step S609), the process proceeds to a step S610, whereas if the status information remains indicative of the closed state (NO to the step S609), the post-processing apparatus controller 300 waits until the status information becomes indicative of the open state.

In the step S610, using the opening/closing detecting circuit 433, the post-processing apparatus controller 300 determines whether or not the sealing door 323 in the opened state has been closed by the user.

More specifically, if the status information becomes indicative of the open state (YES to the step S610), the process proceeds to a step S611, whereas if the status information remains indicative of the open state (NO to the step S610), the post-processing apparatus controller 300 waits until the status information becomes indicative of the closed state.

In the step S611, the post-processing apparatus controller 300 performs the sealing (locking) of the sealing door 323, using the sealing drive circuit 402.

Figure 10:
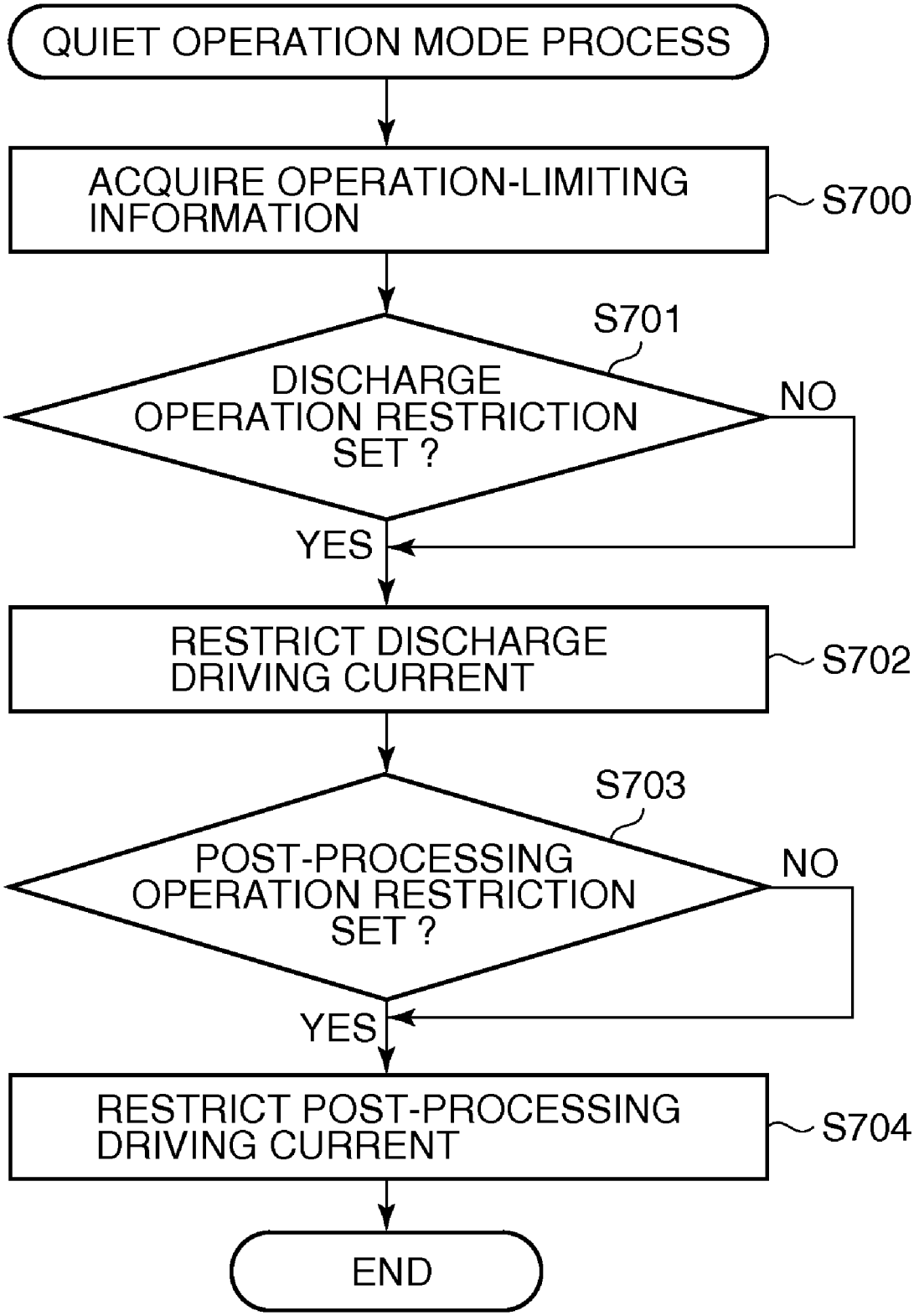
FIG. 10 is a flowchart of a quiet operation mode process executed in a step in FIG. 9.

FIG. 10 is a flowchart of the quiet operation mode process executed in the step S602 in FIG. 9.

The post-processing apparatus controller 300 refers to the configuration information stored in the RAM 502 using the CPU 500, and acquires settings of driving currents supplied to the processing sections, such as the conveying section 301 and the stapler 302, for causing the processing sections to operate in the quiet operation mode (step S700).

Next, the post-processing apparatus controller 300 determines based on the settings acquired in the step S700 whether or not there is a restriction on the driving current supplied to the conveyor motor 301 of the conveying section 301 (step S701. If there is a restriction (YES to the step S701), the process proceeds to a step S702, and then to a step S703, whereas if there is no restriction (NO to the step S701), the process directly proceeds to the step S703.

In the step S702, the post-processing apparatus controller 300 restricts the upper limit value of the driving current supplied to the conveyor motor 301 of the conveying section 301, using the current limiting circuit 421. Here, the term "to restrict the upper limit value of the driving current" has the same meaning mentioned hereinbefore in association with the conveyor motor 301 of the conveying section 301.

In the step S703, the post-processing apparatus controller 300 determines based on the settings acquired in the step S700 whether or not there is a restriction on the driving current supplied to the stapler motor 312 of the stapler 302. If there is a restriction (YES to the step S703), the process proceeds to a step S704, whereas if there is no restriction (NO to the step S703), the process returns to the step S603 in FIG. 9.

In the step S704, the post-processing apparatus controller 300 restricts the upper limit value of the driving current supplied to the stapler motor 312 of the stapler 302, using the current limiting circuit 422. Here, the term "to restrict the upper limit value of the driving current" has the same meaning as mentioned hereinabove in association with the stapler motor 312 of the stapler 302.

Figure 11:
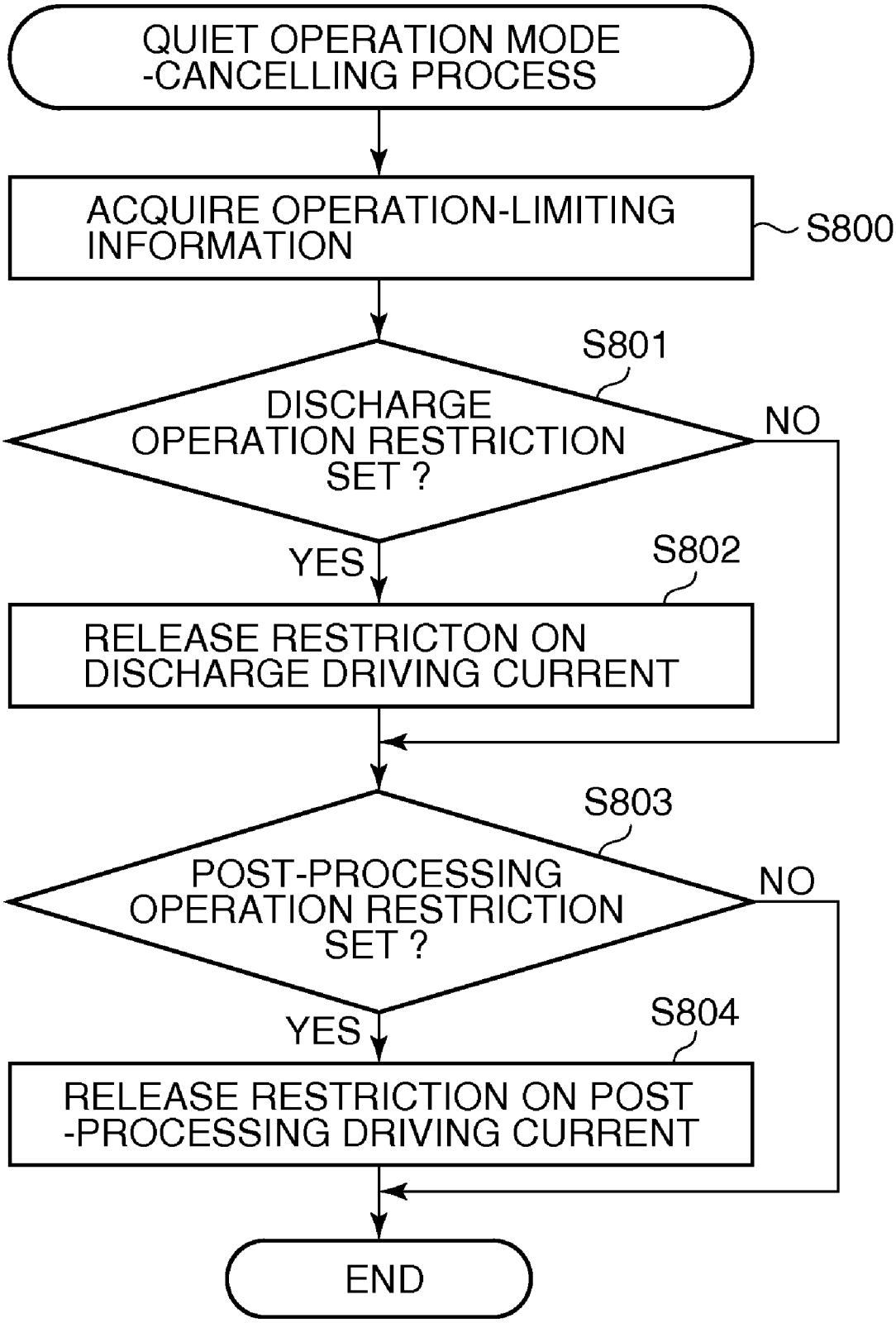
FIG. 11 is a flowchart of a quiet operation mode-cancelling process performed in a step in FIG. 9.

FIG. 11 is a flowchart of the quiet operation mode-cancelling process performed in the step S607 in FIG. 9.

The post-processing apparatus controller 300 refers to the configuration information stored in the RAM 502 using the CPU 500, and acquires settings of driving currents supplied to the processing sections, such as the conveying section 301 and the stapler 302, for causing the processing sections to operate in the quiet operation mode (step S800).

Next, the post-processing apparatus controller 300 determines based on the settings acquired in the step S800 whether or not there is a restriction on the driving current supplied to the conveyor motor 301 of the conveying section 301 (step S801). If there is a restriction (YES to the step S801), the process proceeds to a step S802, and then to a step S803, whereas if there is no restriction (NO to the step S801), the process directly proceeds to the step S803.

In the step S802, the post-processing apparatus controller 300 releases the restriction on the driving current supplied to the conveyor motor 301 of the conveying section 301, by using the current limiting circuit 421. This restriction has been applied in the step S702 in FIG. 10.

In the step S803, the post-processing apparatus controller 300 determines based on the settings acquired in the step S800 whether or not there is a restriction on the driving current supplied to the stapler motor 312 of the stapler 302. If there is a restriction (YES to the step S803), the process proceeds to a step S804, whereas if there is no restriction (NO to the step S803), the present process is terminated.

In the step S804, the post-processing apparatus controller 300 releases the restriction on the driving current supplied to the stapler motor 312 of the stapler 302, using the current limiting circuit 422. This restriction has been applied in the step S704 in FIG. 10.

Next, a fourth embodiment of the present invention will be described with reference to FIGS. 2, 3 and 12.

In the fourth embodiment, as shown in FIG. 2, the apparatus main unit 100 is provided with a user authentication section 208 which is shown in a box indicated by broken lines and is connected to the printer controller 200. An image forming apparatus according to the fourth embodiment is configured similarly to the image forming apparatus according to the first embodiment in the other hardware components. Therefore, the corresponding elements are denoted by identical reference numerals, and description thereof is omitted.

The user authentication section 208 acquires user information from an ID card (non-contact IC card, such as an RFID (Radio Frequency Identification) card) 151 (FIG. 3) that the user has, and checks the acquired user information against user information stored in the memory section 207 to thereby determine whether or not the user is a user registered in advance.

Figure 12:
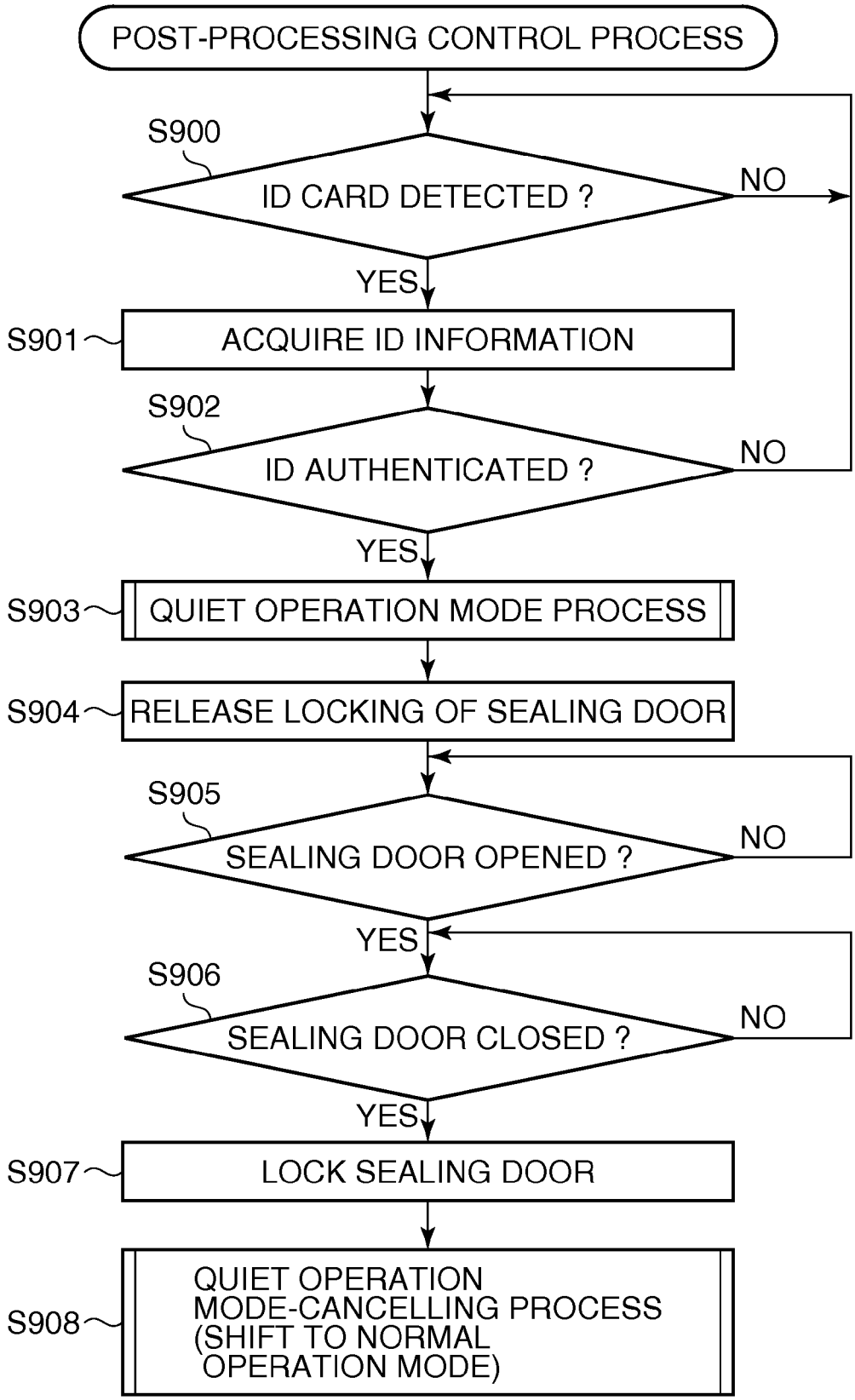
FIG. 12 is a flowchart of a post-processing control process executed by an image forming apparatus (including a user authentication section) according to a fourth embodiment of the present invention.

FIG. 12 is a flowchart of a post-processing control process executed by the image forming apparatus (including the user authentication section 208) according to the fourth embodiment.

First, in a step S900, the printer controller 200 performs wireless communication with the ID card 151 that the user has, using the user authentication section 208. If the printer controller 200 does not detect an ID card 151 that can be used for authentication (NO to the step S900), the printer controller 200 waits until it detects the ID card 151 that can be authenticated. If the printer controller 200 detects the ID card 151 that can be used for authentication, the process proceeds to a step S901.

In the step S901, the printer controller 200 acquires user information from the ID card 151 that the user has, using the user authentication section 208.

Next, the printer controller 200 checks the user information acquired from the ID card 151 that the user has, by using the user authentication section 208, against the user information stored in the memory section 207 to thereby determine whether or not the user is a user registered in advance (step S902). Thus, the printer controller 200 performs user authentication. If the user is authenticated (YES to the step S902), the process proceeds to a step S903, whereas if the user is authenticated (NO to the step S902), the process returns to the step S900.

In the step S903 to a step S908, the same processing is carried out as in the steps S101 to S106 of the FIG. 4 post-processing control process which is carried out by the image forming apparatus according to the first embodiment.

The method of user authentication is not particularly limited to the above-described example. For example, biological information (fingerprint and the like) capable of identifying a user may be read to check the information against user information stored in the memory section 207, to thereby determine whether or not the user is a user registered in advance.

Although in the above-described first to fourth embodiments, restriction on the driving currents (or stoppage of supply of the driving currents) in the quiet operation mode has been described, by way of example, but the appended claims are not particularly limited to the above-described example.

For example, there may be provided a mechanism for mechanically inserting a cushioning member into a driving member for driving the post-processing apparatus 101 or for causing a stopper to operate to mechanically temporarily stop the driving member, such that the operation of the driving member can be hindered.

Further, in the above-described embodiments, the control programs for the respective processes described above with reference to the flowcharts are stored in advance in the memory within the image forming apparatus 100 according to the above-described embodiments, and are read and executed by the predetermined CPUs of the image forming apparatus 100. Thus, the above-described processes are executed by the image forming apparatus 100.

A computer-readable recording medium which stores the programs for thus realizing the configurations of the above-described embodiments is applied to the image forming apparatus 100. In this case, the image forming apparatus may be configured such that the CPU of the printer controller 200 and the CPU of the post-processing apparatus controller 300 cooperate with each other or such that only the CPU of one of the printer controller 200 and the post-processing apparatus controller 300 singly functions.

As described hereinabove, the configurations for realizing the respective processes described with reference to the above-mentioned flowcharts can be subjected to various changes and modifications, insofar as the configurations can be implemented.

Although a detailed description has been given of the embodiments of the present invention, the present invention may be applied to a system comprised of a plurality of apparatuses or to an apparatus comprised of a single apparatus. For example, the image forming apparatus may be configured such that the control of the above-described embodiments is performed by an image forming system which is connected to a printer applicable as the apparatus body (image forming apparatus) 100 and a finisher applicable as the post-processing apparatus 101, to thereby control the above-described embodiments.

It is to be understood that the present invention may also be accomplished by directly or remotely supplying a system or an apparatus with a program code of software, which realizes the functions of any of the above described embodiments, and causing a computer (or CPU or MPU) of the system or apparatus to read out and execute the supplied program code.

In this case, for example, the above-described image forming system is configured such that the program code is downloaded to a remote computer which remotely controls the image forming system, and the control of the above-described embodiments is performed by a CPU of the computer. The present invention can be applied to such an embodiment.

The present invention is also realized by a program code itself which is installed in a computer for realizing the functions of the invention as described above, on the computer. That is, the present invention encompasses the program code itself for realizing the functions of the invention.

The form of the above program code may be an object code, a program executed by an interpreter, script data supplied to an OS (Operating System), or the like, but is not particularly limited.

Examples of the computer-readable storage medium for supplying the program code include a floppy (registered trademark) disk, a hard disk, an optical disk, a magnetic-optical disk, an MO, a CD-ROM, a CD-R, a CD-RW, a magnetic tape, a nonvolatile memory card, a ROM, a DVD (a DVD-ROM, a DVD-R).

Further, it is possible to supply the program by downloading the same from a home page on the Internet to a storage medium, such as a hard disk, using a browser of a client computer. In this case, the computer program itself according to the present invention, or a file compressed and containing an automatic install function may be downloaded.

Further, the program of the present invention can be realized by dividing the program code constituting the program into a plurality of files and downloading the respective files from different home pages. In short, a WWW server as well, which is provided for downloading program files for realizing the functions and processes according to the present invention, to a plurality of users, is encompassed by the present invention.

Further, the program of the present invention may be encrypted and stored in storage media, such as CD-ROMs, such that it is distributed to users. In this case, users that have satisfied predetermined conditions may be caused to download key information for releasing the encryption, from the home page via the Internet, to install the encrypted program on a computer of the user in an executable form by using the key information.

Further, it is to be understood that the functions of the above described embodiments may be accomplished by executing the program code read out by a computer even in a form other than the above-described form, in which the functions of the above described embodiments can be accomplished. For example, the functions of the above described embodiments can be accomplished by causing an OS (operating system) or the like which operates on the computer to perform a part or all of the actual operations based on instructions of the program code.

Further, it is to be understood that the functions of any of the above described embodiments may be accomplished by writing a program code read out from the computer-readable storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2008-172247 filed Jul. 1, 2008, which is hereby incorporated by reference herein in its entirety.

What is claimed is:

1. A sheet processing apparatus that is disposed at a location downstream of an image forming apparatus in a sheet conveying direction thereof for performing a post-processing on sheets printed by the image forming apparatus, and includes a plurality of discharge trays and a single door for sealing the discharge trays, the sheet processing apparatus comprising:

a receiving unit configured to receive a signal from a sensor indicating opening of the single door through which the printed sheets are discharged;

a control unit configured to control the sheet processing apparatus to switch from a first operation mode to a second operation mode in response to the receiving unit receiving the signal from the sensor indicating opening of the single door;

at least one electric motor that operates during the post-processing on the printed sheets, wherein the sheet processing apparatus operates the at least one electric motor to draw less current in the second operation mode than in the first operation mode to perform the post-processing on the printed sheets quieter in the second operation mode than in the first operation mode.

2. The sheet processing apparatus according to claim 1, further comprising:

a determining unit configured to determine whether or not the post processing is being performed, wherein the control unit does not control the sheet processing apparatus to switch from the first operation mode to the second operation mode so long as the determining unit determines that the post processing is not being performed even if the receiving unit receives the instruction of opening the single door.

3. The sheet processing apparatus according to claim 1, wherein:

the single door is locked in a closed state, the receiving unit is further configured to receive an instruction of releasing locking of the single door, the control unit controls the sheet processing apparatus to switch from the first operation mode to the second operation mode in response to the receiving unit receiving the signal of releasing locking of the single door.

4. The sheet processing apparatus according to claim 1, wherein the control unit controls the sheet processing apparatus to switch from the second operation mode to the first operation mode in response to the single door being closed.

5. A method of controlling a sheet processing apparatus that is disposed at a location downstream of an image forming apparatus in a sheet conveying direction thereof for performing a post-processing on sheets printed by the image forming apparatus, and includes a plurality of discharge trays and a single door for sealing the discharge trays, and at least one electric motor that operates during the post-processing on the printed sheets, the method comprising:

a receiving step of receiving a signal from a sensor indicating opening of the single door through which the printed sheets are discharged;

a control step of controlling the sheet processing apparatus to switch from a first operation mode to a second operation mode in response to the receiving unit receiving the signal from the sensor indicating opening of the single door; and a quiet operation step of operating the at least one electric motor to draw less current in the second operation mode than in the first operation mode to perform the post-processing on the printed sheets quieter in the second operation mode than in the first operation mode.

6. A non-transitory computer-readable storage medium storing a computer program for controlling a sheet processing apparatus that is disposed at a location downstream of an image forming apparatus in a sheet conveying direction thereof for performing a post-processing on sheets printed by the image forming apparatus, and includes a plurality of discharge trays and a single door for sealing the discharge trays, and at least one electric motor that operates during the post-processing on the printed sheets, the computer program being executable by the sheet processing apparatus to carry out a method comprising:

a receiving step of receiving a signal from a sensor indicating opening of the single door through which the printed sheets are discharged;

a control step of controlling the sheet processing apparatus to switch from a first operation mode to a second operation mode in response to the receiving unit receiving the signal from the sensor indicating opening of the single door; and a quiet operation step of operating the at least one electric motor to draw less current in the second operation mode than in the first operation mode to perform the post-processing on the printed sheets quieter in the second operation mode than in the first operation mode.

* * * * *